US007869573B2

(12) United States Patent
Banchieri

(10) Patent No.: US 7,869,573 B2
(45) Date of Patent: Jan. 11, 2011

(54) COLLIMATOR AND METHOD FOR FABRICATING THE SAME

(75) Inventor: Andrew John Banchieri, Freemont, CA (US)

(73) Assignee: Morpho Detection, Inc., Newark, CA (US)

( * ) Notice: Subject to any disclaimer, the term of this patent is extended or adjusted under 35 U.S.C. 154(b) by 16 days.

(21) Appl. No.: 11/965,366

(22) Filed: Dec. 27, 2007

(65) Prior Publication Data

US 2009/0168968 A1 Jul. 2, 2009

(51) Int. Cl.
*G21K 1/02* (2006.01)

(52) U.S. Cl. ..... 378/147; 378/154

(58) Field of Classification Search ..... 378/154, 378/145, 147, 149, 160
See application file for complete search history.

(56) References Cited

U.S. PATENT DOCUMENTS 4,951,305 A * 8/1990 Moore et al. ..... 378/147
5,182,764 A 1/1993 Peschmann et al.
5,367,552 A 11/1994 Peschmann
5,729,585 A * 3/1998 Pellegrino et al. ..... 378/154
6,430,255 B2 8/2002 Fenkart et al.
6,778,637 B2 * 8/2004 Luhta et al. ..... 378/154
7,010,083 B2 3/2006 Hoffman
7,112,798 B2 9/2006 Hoffman
7,141,812 B2 11/2006 Appleby et al.
2002/0064252 A1 * 5/2002 Igarashi et al. ..... 378/19
2002/0110216 A1 * 8/2002 Saito et al. ..... 378/19
2005/0169430 A1 * 8/2005 Hoffman ..... 378/147
2006/0291617 A1 12/2006 Freund et al.
2007/0133737 A1 6/2007 Yahata et al.
2007/0152159 A1 7/2007 Short et al.

OTHER PUBLICATIONS

"Nasa Awards Mikro Systems Phase III SBIR Contract", http://www.mikrosystems.com/php-bin/news/showAritcle.php?id=14; 2007, MIKRO, Inc.; 2 pages.
"Applications" http://www.mikrosystems.com/apps/rid.php; 2007, MIKRO, Inc.; 2 pages.

* cited by examiner

*Primary Examiner*—Hoon Song
(74) *Attorney, Agent, or Firm*—Armstrong Teasdale LLP

(57) ABSTRACT

A method for fabricating a collimator assembly is provided. The collimator assembly includes a first collimator grid having a first surface and an opposing second surface, wherein the first collimator grid defines a plurality of cells. Each cell of the plurality of cells is aligned in a first direction and extends between the first surface and the second surface. The method includes coupling a reinforcing layer to the first collimator grid such that the reinforcing layer extends substantially perpendicular to the first direction.

17 Claims, 5 Drawing Sheets

COLLIMATOR AND METHOD FOR FABRICATING THE SAME

FIELD OF THE INVENTION

The field of the invention relates generally to collimators and, more particularly, to a secondary collimator for use with a computed tomography detection system.

BACKGROUND OF THE INVENTION

At least some known X-ray and/or computed tomography (CT) detection systems include a secondary collimator to facilitate ensuring acceptable detector performance by excluding scatter X-rays from reaching the detector. In some known CT detection systems, the secondary collimator is coupled to a gantry such that the secondary collimator rotates with an X-ray source and the detector.

At least one known secondary collimator includes an array of identical modules (i.e., of 32×32 cells each) that are tiled side-by-side along an arc of the array. However, such tiling only allows for attachment on untiled ends of the array. When such an array is subjected to centrifugal loads, each module is deflected by an unacceptable amount. More specifically, because the gantry rotates about a point closer to the array than to a focal spot, the collimator modules are subjected to forces in a non-perpendicular or non-normal direction, which tends to bend the collimator, particularly at the ends of the array. Such bending and/or deflection of the collimator may allow radiation that should have been excluded from reaching the detector to be received by the detector and used in further processing. More specifically, any bending of the collimator de-focuses the collimator and frustrates the function of the collimator to allow only those X-rays that travel on a straight line between the X-ray source and the detector cell to be received at the detector cell. For example, each cell of the collimator is focused to a focal spot, and deflection of the collimator in any direction moves the cells out of such a focused condition. As such, the CT system may provide false positives or otherwise improperly detect materials and/or objects within a container being imaged.

BRIEF DESCRIPTION OF THE INVENTION

In one aspect, a method for fabricating a collimator assembly is provided. The collimator assembly includes a first collimator grid having a first surface and an opposing second surface, wherein the first collimator grid defines a plurality of cells. Each cell of the plurality of cells is aligned in a first direction and extends between the first surface and the second surface. The method includes coupling a reinforcing layer to the first collimator grid such that the reinforcing layer extends substantially perpendicular to the first direction.

In another aspect, a collimator assembly is provided. The collimator assembly includes a first collimator grid including a first surface and a second surface. The first collimator grid defines a plurality of first cells, wherein each first cell is aligned in a first direction and extends between the first surface and the second surface. The collimator assembly also includes a reinforcing layer coupled to the first collimator grid such that the reinforcing layer is substantially perpendicular to the first direction. The reinforcing layer includes a substantially X-ray transparent material.

In still another aspect, a detection system is provided. The detection system includes an X-ray source for generating an X-ray beam, a multi-row detector, and an examination zone defined between the X-ray source and the multi-row detector.

The detection system also includes a collimator assembly coupled between the multi-row detector and the examination zone. The collimator assembly includes a first collimator grid including a first surface and a second surface. The first collimator grid defines a plurality of first cells, wherein each first cell is aligned in a first direction and extends between the first surface and the second surface. The collimator assembly also includes a reinforcing layer coupled to the first collimator grid such that the reinforcing layer is substantially perpendicular to the first direction. The reinforcing layer includes a substantially X-ray transparent material.

BRIEF DESCRIPTION OF THE DRAWINGS

FIG. 1 is a perspective view of an exemplary multi-slice CT imaging system implementing a method for improving a resolution of an image.

FIG. 2 is a block diagram of the CT imaging system shown in FIG. 1.

FIG. 3 is a top view of an exemplary secondary collimator for use with the system shown in FIGS. 1 and 2.

FIG. 4 is a cross-sectional view of the secondary collimator shown in FIG. 3 taken at line 4-4.

FIG. 5 is an enlarged partial view of the secondary collimator shown in FIG. 4 taken at area 5.

DETAILED DESCRIPTION OF THE INVENTION

The embodiments described herein provide systems and methods for imaging an object to determine if contraband, such as explosives, weapons, and/or drugs, and/or an anomaly is present in an object. In one embodiment, a system acquires images using a radiation source. At least one embodiment of the present invention is described below in reference to its application in connection with and operation of a system for inspecting containers. However, it should be apparent to those skilled in the art and guided by the teachings herein provided that the invention is likewise applicable to any suitable system for scanning containers including, without limitation, crates, cargo, boxes, drums, baggage, luggage, and suitcases, transported by water, land, and/or air, as well as other containers and/or objects.

Moreover, although the embodiments are described below in reference to application in connection with and operation of a system incorporating an X-ray computed tomography (CT) system for inspecting containers, it should apparent to those skilled in the art and guided by the teachings herein provided that any suitable radiation source including, without limitation, neutrons or gamma rays, may be used in alternative embodiments. Further, it should be apparent to those skilled in the art and guided by the teachings herein provided that the collimator described herein may be used in other applications, such as medical applications.

Figure 1:
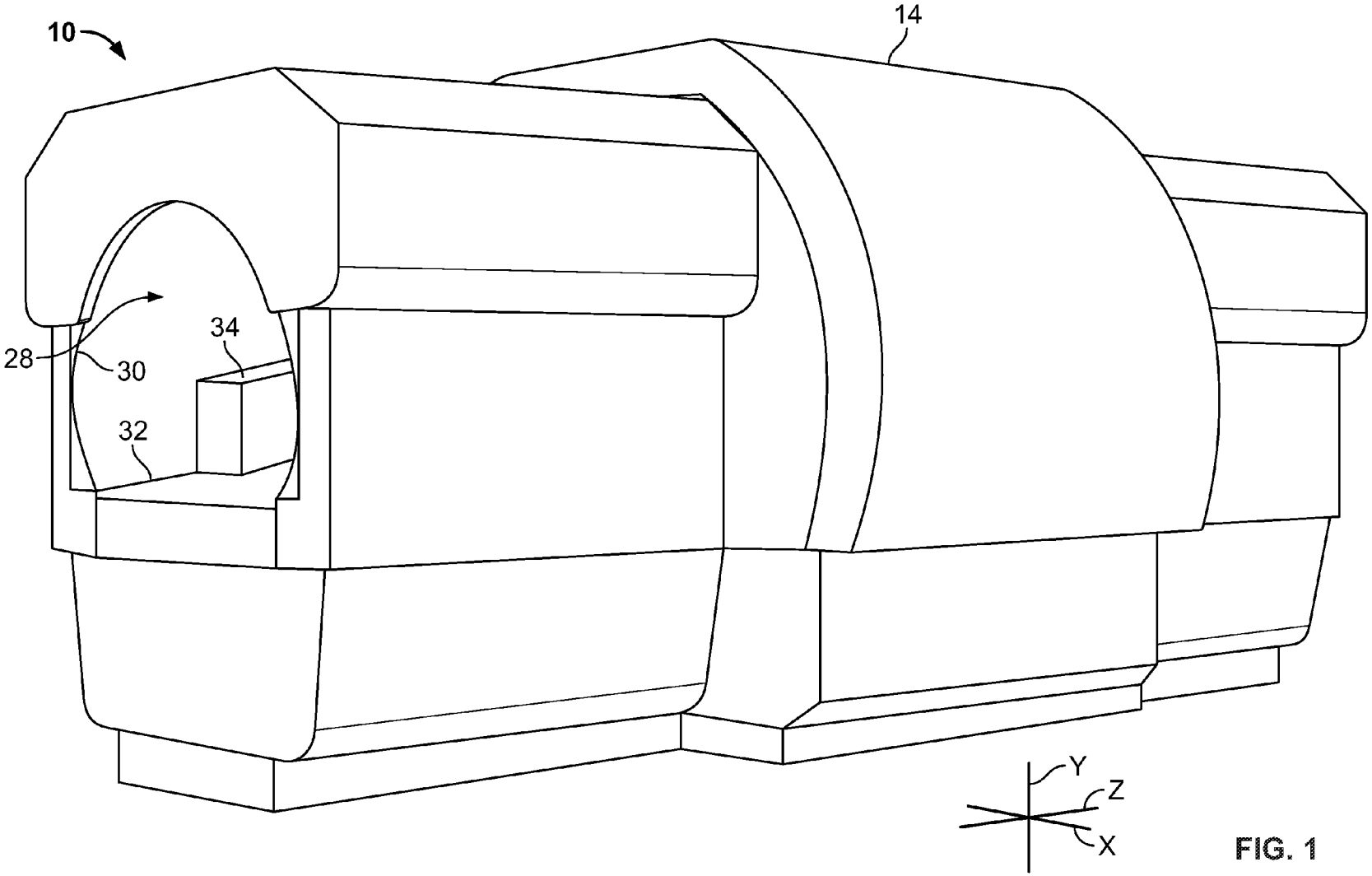
FIGS. 1-5 show exemplary embodiments of the systems and methods described herein.
Figure 2:
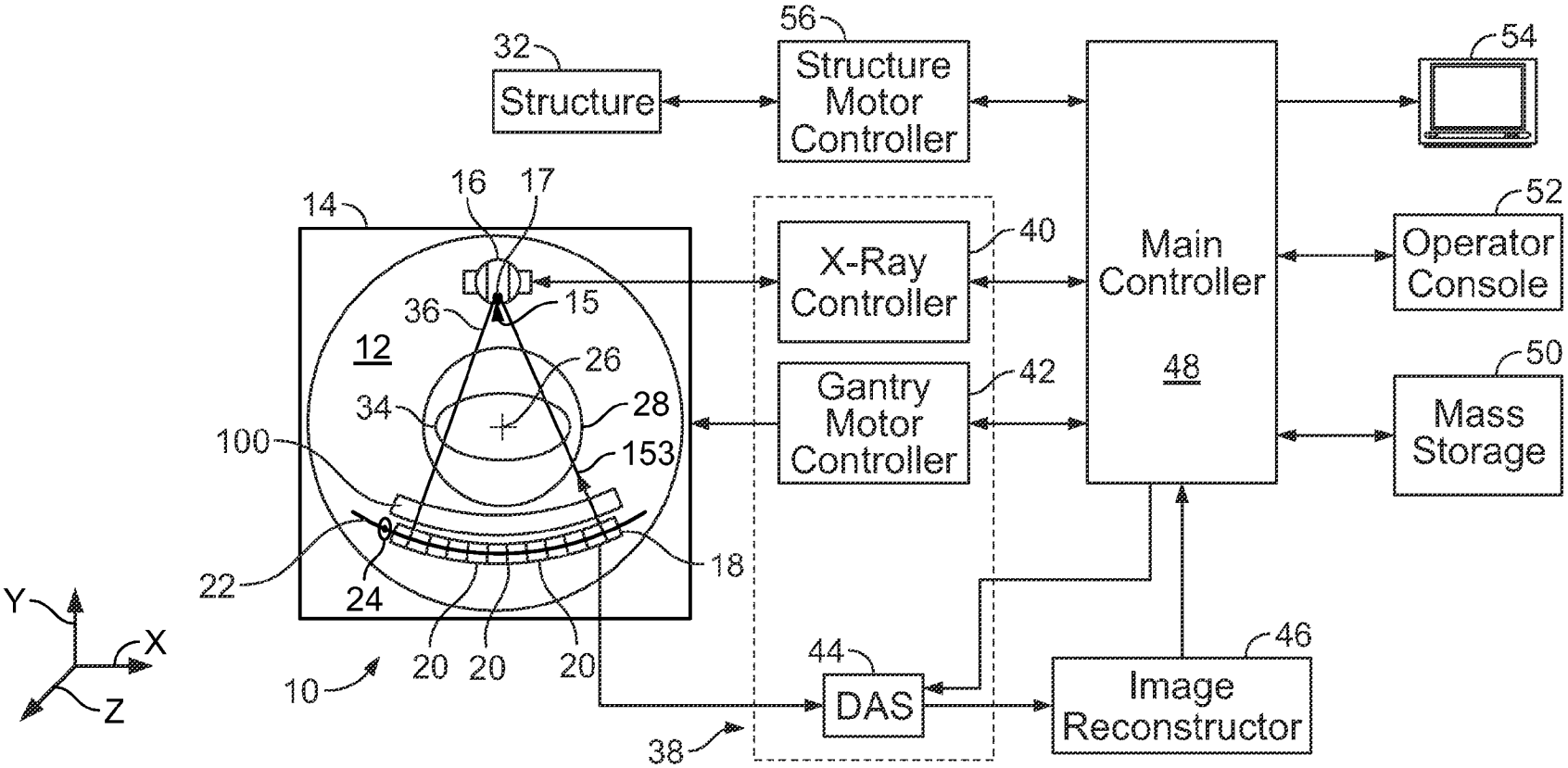

Referring to FIGS. 1 and 2, an exemplary embodiment of a computed tomography (CT) explosives detection system (EDS) 10 that includes multiple operational modes to yield high throughputs. In one embodiment, EDS 10 is integrated into an airport installation. EDS 10 includes a gantry 12 within a housing 14. Gantry 12 includes a rotating inner portion (not shown) having an X-ray source 16 and a detector array 18 coupled thereto. In the exemplary embodiment, detector array 18 includes multiple rows of detector elements 20 and/or multiple channels of detector elements 20. Detector elements 20 include detector crystals. The detector channels are parallel to a channel axis 22, which is parallel to a plane of gantry 12. The detector rows are parallel to a row axis 24, which is parallel to a Z-axis. Each detector row is displaced from all other detector rows in a Z-direction along a center axis 26 about which gantry 12 rotates. Center axis 26 is substantially parallel to the Z-axis. Further, in the exemplary embodiment, EDS 10 includes a secondary collimator 100, as described in more detail below, that is coupled between X-ray source 16 and detector array 18. An examination zone 28 is defined within housing 14 between X-ray source 16 and secondary collimator 100. Examination zone 28 is accessed through an opening 30 in housing 14.

In the exemplary embodiment, EDS 10 includes a support structure 32 within examination zone 28. Support structure 32 is configured to translate an object 34 along center axis 26, parallel to the Z-direction, between X-ray source 16 and detector array 18 to perform a helical scan of examination zone 28, or is configured to maintain the position of object 34 along center axis 26 throughout an axial scan of object 34. More specifically, in the exemplary embodiment, support structure 32 is a conveyor apparatus.

During operation, in the exemplary embodiment, support structure 32 conveys object 34 into examination zone 28. X-ray source 16, detector array 18, and secondary collimator 100 revolve with rotation of gantry 12. More specifically, X-ray source 16, detector array 18, and secondary collimator 100 rotate about center axis 26 such that X-ray source 16, detector array 18, and secondary collimator 100 rotate about object 34 placed on support structure 32. X-ray source 16 includes a focal spot 15 having a center 17. X-ray source 16 generates a beam 36 of X-rays and projects beam 36 towards detector array 18. Beam 36, after passing through object 34, is detected at detector array 18 to generate projection data that is used to create a CT image (not shown) of object 34. More specifically, as beam 36 passes through object 34, beam 36 is attenuated and may create scattered radiation (not shown). Secondary collimator 100 allows only radiation (not shown) at a predetermined angle (not shown), for example, an angle representing a line between X-ray source 16 and a detector element 20, to beam 36 to pass through secondary collimator 100. More specifically, collimator 100 substantially attenuates radiation at other than the predetermined angle, or off-angle radiation, before such off-angle radiation is received at detector array 18 such that a signal produced by the off-angle radiation is substantially lower than a signal produced by radiation at the predetermined angle, which as attenuated by object 34. Beam 36, after passing through secondary collimator 100, is received by multiple detector elements 20 in multiple detector rows of detector array 18. Detector elements 20 generate projection data, which represent electrical signals corresponding to intensities of beam 36.

EDS 10 includes a plurality of components to enable operation, such as the above-described operation. More specifically, in the exemplary embodiment, rotation of gantry 12 and an operation of X-ray source 16 are governed by a control mechanism 38. Control mechanism 38 includes an X-ray controller 40 that provides power and timing signals to X-ray source 16, and a gantry motor controller 42 that controls a speed and/or rotation and a position of gantry 12. A data acquisition system (DAS) 44 samples projection data from detector elements 20 and converts the projection data from an analog form to digital signals to generate sampled and digitized projection data, which is actual projection data. An image reconstructor 46 receives actual projection data from DAS 44 and performs image reconstruction to generate the CT image. A main controller 48 stores the CT image in a mass storage device 50. Examples of mass storage device 50 include a nonvolatile memory, such as a read only memory (ROM), and a volatile memory, such as a random access memory (RAM). Other examples of mass storage device 50 include a floppy disk, a compact disc-ROM (CD-ROM), a magneto-optical disk (MOD), and a digital versatile disc (DVD).

Main controller 48 also receives commands and scanning parameters from an operator (not shown) via an operator console 52. A display monitor 54 allows the operator to observe the CT image and other data from main controller 48. Display monitor 54 may be a cathode ray tube (CRT) or a liquid crystal display (LCD). The operator supplied commands and parameters are used by main controller 48 in operation of DAS 44, X-ray controller 40, and/or gantry motor controller 42. In addition, main controller 48 operates a support structure motor controller 56, which translates support structure 32 to position object 34 within system housing 14. Moreover, in the exemplary embodiment, main controller 48 uses computer algorithms to analyze the image and compare CT properties of the image with CT properties of known contraband materials. If a match is found, main controller 48 sounds an alarm and displays object 34 on display monitor 54 such that the operator may view the image to determine whether a real threat exists.

X-ray controller 40, gantry motor controller 42, image reconstructor 46, main controller 48, and/or structure motor controller 56 are not limited to only those integrated circuits referred to in the art as a controller, but broadly refers to a computer, a processor, a microcontroller, a microcomputer, a programmable logic controller, an application specific integrated circuit, and/or any other programmable circuit. X-ray controller 40, gantry motor controller 42, image reconstructor 46, main controller 48, and/or structure motor controller 56 may be a portion of a central control unit (not shown) or may each be a stand-alone component, as shown.

Although the embodiment mentioned above refers to a third generation CT imaging system, secondary collimator 100, as described herein, may be coupled to fourth generation CT systems that have a stationary detector and a rotating x-ray source, to fifth generation CT systems that have a stationary detector and an electron-beam deflected x-ray source, future generations of CT systems involving multiple x-ray sources and/or detectors, and/or to an emission CT system, such as a single photon emission CT system (SPECT) or a positron emission tomographic system (PET).

Figure 3:
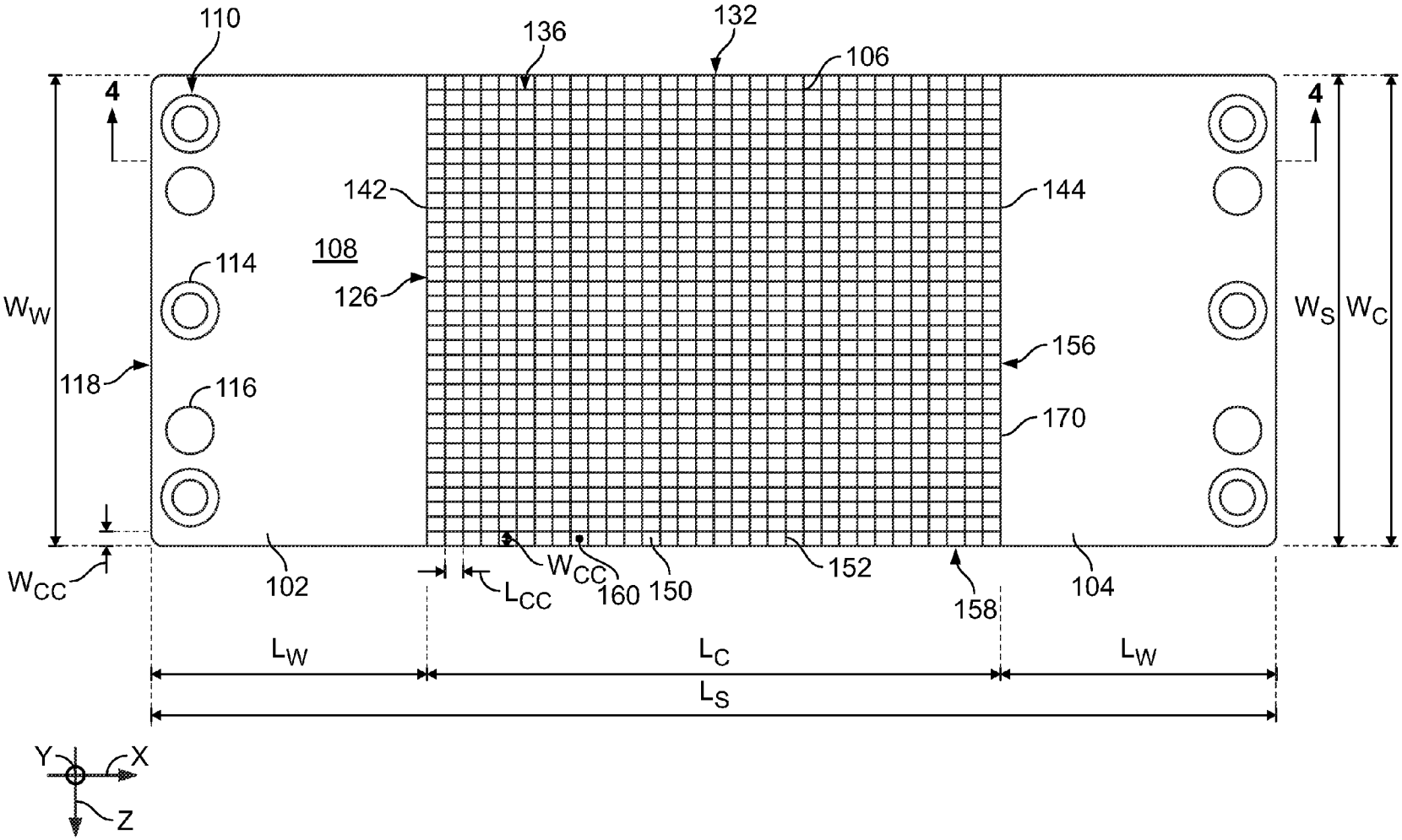
Figure 4:
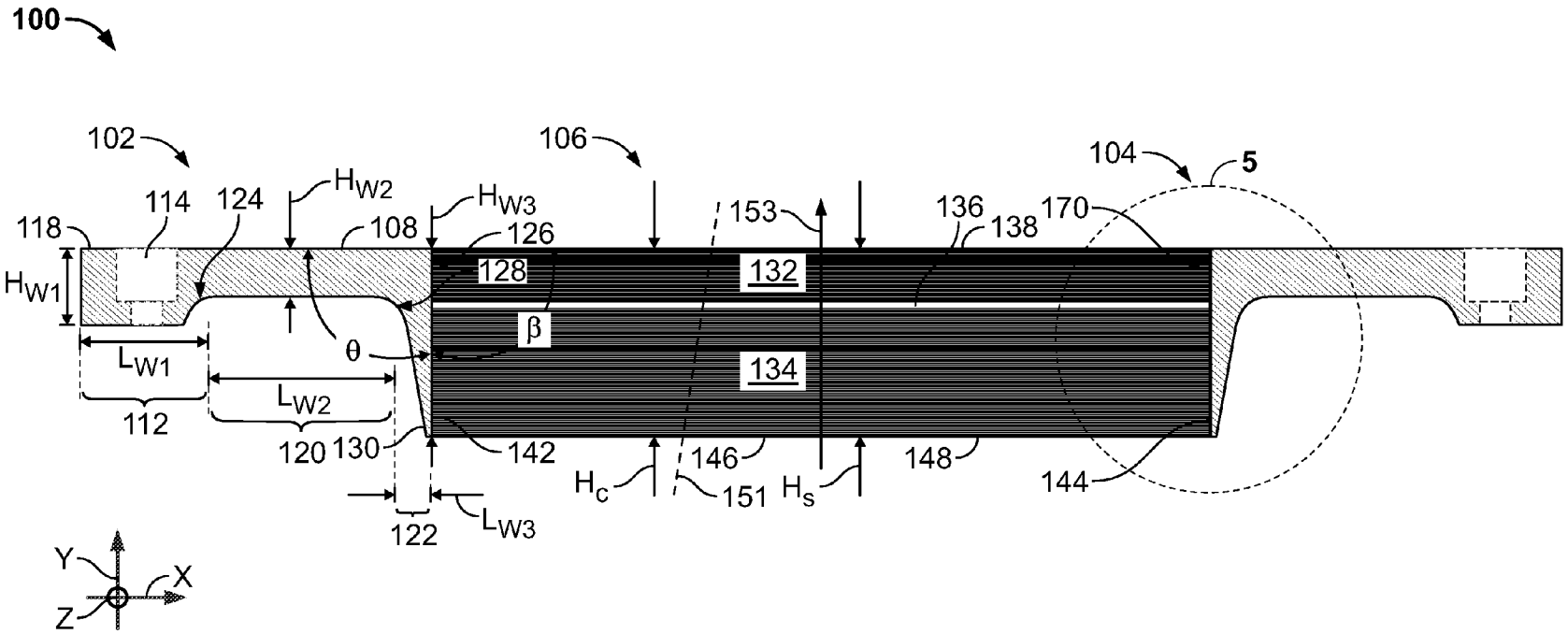
Figure 5:
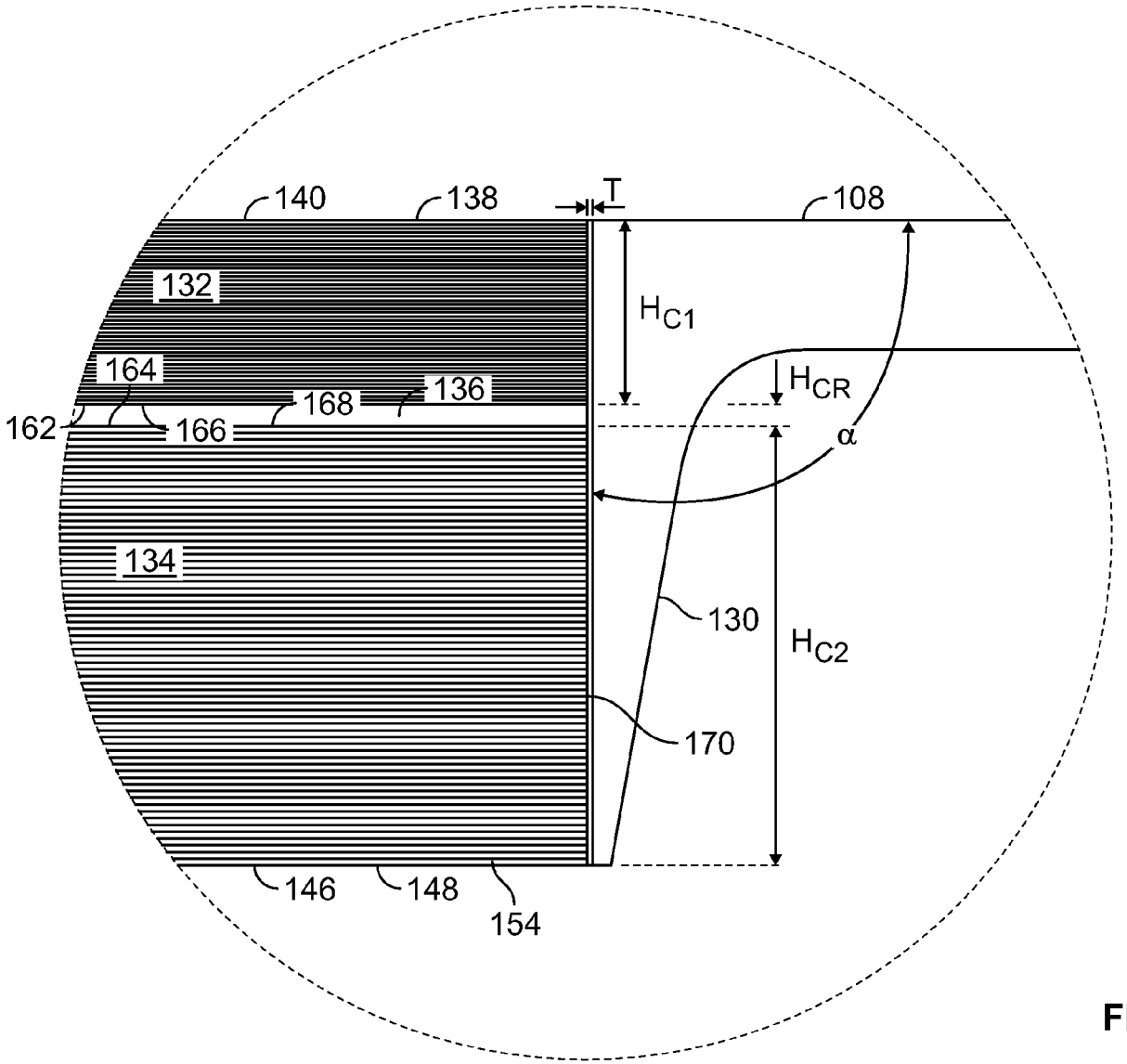

FIG. 3 is a top view of secondary collimator 100 suitable for use with EDS 10 (shown in FIGS. 1 and 2). FIG. 4 is a cross-sectional view of secondary collimator 100 taken at line 4-4 shown in FIG. 3. FIG. 5 is an enlarged partial view of secondary collimator 100 taken at area 5 shown in FIG. 4.

In the exemplary embodiment, secondary collimator 100 includes a first attachment wing 102, a second attachment wing 104, and a collimator assembly 106. Collimator assembly 106 is an assembly that substantially attenuates a portion of radiation and is substantially transparent to another portion of radiation. In the exemplary embodiment, collimator assembly 106 is fabricated from a tungsten-loaded epoxy. Secondary collimator 100 has a length $L_S$, a width $W_S$, and a height $H_S$ that are selected based on the dimensions and/or configuration of EDS 10. Width $W_S$, length $L_S$, and/or height $H_S$ are any suitable dimensions that enable secondary collimator 100 to function as described herein.

Although only first attachment wing 102 is described herein for simplicity, it should be understood that second attachment wing 104 has a substantially similar configuration as first attachment wing 102. In the exemplary embodiment, first attachment wing 102 is fabricated, using any suitable fabrication technique, from a material having a high tensile strength and/or high elasticity, such as steel and/or any other suitable material, and has a length $L_W$ and a width $W_W$ that are selected based on the dimensions and/or configuration of EDS 10. Width $W_W$ and/or length $L_W$ are any suitable dimensions that enable secondary collimator 100 to function as described herein. In the exemplary embodiment, each component of first attachment wing 102 has width $W_W$, unless otherwise described herein. An outer surface 108 of first attachment wing 102 has an area of width $W_W$ times length $L_W$ and is substantially planar.

Further, in the exemplary embodiment, first attachment wing 102 includes a plurality of apertures 110 defined within a first portion 112 (shown in FIG. 4). In the exemplary embodiment, apertures 110 include counter-bored apertures 114 and straight apertures 116, however, apertures 110 may have any configuration that enables ESD 10 to function as described herein. More specifically, fasteners (not shown) positioned within apertures 110 couple secondary collimator 100 to gantry 12 (shown in FIG. 2). First portion 112 includes a length $L_{W1}$ and a height $H_{W1}$. Length $L_{W1}$ is measured between a first end surface 118 of wing 102 and a first fillet 124 at a beginning 119 of a second portion 120 of wing 102, and length $L_{W1}$ and height $H_{W1}$ are selected based on the dimensions and/or configuration of EDS 10. In one embodiment, length $L_{W1}$ and height $H_{W1}$ are selected to minimize a characteristic, such as the weight, of attachment wing 102.

In the exemplary embodiment, second portion 120 of wing 102 extends between first portion 112 and a third portion 122 of wing 102. Second portion 120 has a length $L_{W2}$ and a generally constant height $H_{W2}$. Length $L_{W2}$ is greater than length $L_{W1}$, and height $H_{W2}$ is less than height $H_{W1}$. Alternatively, length $L_{W2}$ is less than or equal to length $L_{W1}$ and height $H_{W2}$ is greater than or equal to height $H_{W1}$. In the exemplary embodiment, height $H_{W1}$ tapers to height $H_{W2}$ at first fillet 124. In one embodiment, length $L_{W2}$ is selected based on a design of collimator 100. For example, length $L_{W2}$ is selected based on a number of cells defined within collimator 100.

Further, in the exemplary embodiment, third portion 122 extends between second portion 120 and a second end surface 126. Third portion 122 has a length $L_{W3}$ and a height $H_{W3}$. In the exemplary embodiment, length $L_{W3}$ is less than length $L_{W1}$ and/or length $L_{W2}$ and height $H_{W3}$ is greater than height $H_{W1}$ and/or height $H_{W2}$. More specifically, in the exemplary embodiment, height $H_{W3}$ is approximately equal to secondary collimator height $H_S$ and third portion 122 includes a second fillet 128 and an inner surface 130 that taper from height $H_{W2}$ to $H_{W3}$ along length $L_{W3}$. In the exemplary embodiment, inner surface 130 is at an angle θ to wing outer surface 108. Angle θ may be selected to facilitate reducing stress induced within collimator 100 during an operation of EDS 10. Moreover, in the exemplary embodiment, second end surface 126 is configured to couple wing 102 to collimator assembly 106. For example, second end surface 126 may be textured, treated, and/or processed to adhesively bond to collimator assembly 106. In the exemplary embodiment, second end surface 126 is at an angle α to wing outer surface 108, as shown in FIG. 5. In one embodiment, angle α is selected to correspond to a line between X-ray source 16 (shown in FIG. 2) and detector array 18 (shown in FIG. 2).

Collimator assembly 106, in the exemplary embodiment, includes a first collimator grid 132, a second collimator grid 134, and a reinforcing layer 136 positioned between first collimator grid 132 and second collimator grid 134. In the exemplary embodiment, first collimator grid 132 is a Diode Protection Grid (DPG) of a thickness to facilitate attenuating any radiation to a substantially safe level before the radiation passes through spaces defined between detector crystals of detector array 18 and impact non-active areas of detector array 18. More specifically, cells 150 in first collimator grid 132 conceal a relatively small portion at perimeters of the detector crystals, and the detector crystals attenuate a balance of the radiation before the radiation is received at active areas of detector array 18. As such, in the exemplary embodiment, tolerances held on position and cell size of first collimator grid 132 are tight, such that a maximum amount of detector crystal is exposed to radiation, without exposing the spaces between the crystals to radiation. Further, in the exemplary embodiment, second collimator grid 134 is an Anti Scatter Grid (ASG). More specifically, second collimator grid 134 has constant wall thicknesses that are selected such that the thickness is substantially at a minimum acceptable thickness to properly attenuate the scattered radiation. By minimizing the wall thicknesses of second collimator grid 134, overall weight of collimator 100 is facilitated to be reduced such that the stresses induced under a load as facilitated to be reduced. In the exemplary embodiment, the cell size of second collimator grid 134 is larger than that the cell size of first collimator grid 132, the cell size and/or cell position tolerances of second collimator grid 134 may be less restrictive than for the cell size and/or cell position tolerances of first collimator grid 132.

Collimator assembly 106 has a width $W_C$, a length $L_C$, and a height $H_C$. More specifically, in the exemplary embodiment, width $W_C$ is substantially equal to widths $W_S$ and/or $W_W$, length $L_C$ is greater than length $L_W$, and height $H_C$ is substantially equal to height $H_S$. Width $W_C$, length $L_C$, and/or height $H_C$ are any suitable dimensions that enable secondary collimator 100 to function as described herein. In the exemplary embodiment, each component of collimator assembly 106 has width $W_C$ and length $L_C$, unless otherwise described herein.

Further, an outer surface 138 of collimator assembly 106 is substantially planar and is substantially co-planar with first attachment wing outer surface 108. In the exemplary embodiment, collimator assembly outer surface 138 is at least partially defined by an outer surface 140 of first collimator grid 132 and is substantially perpendicular to X-ray beam 36 (shown in FIG. 2). Collimator assembly 106 also includes a first end surface 142 and a generally opposite second end surface 144. In the exemplary embodiment, each end surface 142 and 144 is configured and/or oriented at an angle β to outer surface 138, wherein angle β is a supplementary angle to angle α. In one embodiment, angle β is selected to facilitate minimizing weight and/or facilitate maintaining acceptable stress levels. Furthermore, first end surface 142 is adjacent and coupled to second end surface 126 of first wing 102, and second end surface 144 is adjacent and coupled to second end surface 126 of second wing 104. Moreover, an inner surface 146 of collimator assembly 106 is substantially parallel to outer surface 138 and is at least partially defined by an inner surface 148 of second collimator grid 134.

Referring further to FIG. 3, collimator assembly 106 includes a plurality of cells 150 that define a grid 152 of radiation-absorbing material in collimator assembly 106. As used herein, the term "radiation-absorbing material" includes materials that absorb and/or attenuate a relatively large amount of radiation that is directed to the material. In the exemplary embodiment, grid 152 is formed of a plurality of layers 154, shown in FIG. 5, of any suitable radiation-absorbing material including, without limitation, a tungsten-loaded epoxy. In one embodiment, grid 152 is fabricated by casting. Further, in the exemplary embodiment, each cell 150 extends through first collimator grid 132 and second collimator grid 134 along a respective direction 153 that is substantially aligned to center 17 (shown in FIG. 2) of focal spot 15 (shown in FIG. 2) of X-ray source 16. More specifically, direction 153 varies depending on the location of cell 150 with respect to collimator assembly 106 such that each cell 150 is at a substantially unique and focused direction. As such, an axis 151 of each cell 150 is substantially aligned to a center of a focal spot of X-ray source 16.

Each cell 150 is intersected by reinforcing layer 136 that is oriented substantially parallel to inner surface 146 and/or outer surface 138. As such, reinforcing layer 136 is a continuous sheet of material that extends approximately perpendicularly through each cell 150. In the exemplary embodiment, reinforcing layer 136 is any suitable radiation-transparent and/or low attenuation material including, without limitation, a carbon fiber and/or an aluminum material. As used herein the term "radiation-transparent material" includes materials that are allow a relatively large amount of radiation to pass therethrough at any thickness, which do not substantially attenuate an X-ray signal and/or X-ray radiation.

Furthermore, in the exemplary embodiment, cells 150 are at a predetermined angle to X-ray beam 36 such that axis 151 of each cell 150 is substantially aligned with center 17 of focal spot 15. Moreover, cells 150 are arranged in rows 156 and columns 158 such that each cell 150 is substantially aligned with one or more adjacent cells 150. In the exemplary embodiment, a number of cells 150 is equal to a number of detector elements 20 (shown in FIG. 2). More specifically, in the exemplary embodiment, a number and/or an alignment of cells 150 is selected based on the number and/or alignment of detector elements 20. Alternatively, cells 150 may be oriented and/or aligned in any suitable configuration that enables secondary collimator 100 to function as described herein. In the exemplary embodiment, each cell 150 has a length $L_{CC}$ and a width $W_{CC}$. Length $L_{CC}$ and/or width $W_{CC}$ in first collimator grid 132 and/or second collimator grid 134 may be approximately equal, and/or length $L_{CC}$ and/or width $W_{CC}$ in second collimator grid 134 may be smaller than in first collimator grid 132.

In the exemplary embodiment, the dimensions of cell centers 160 may be calculated using any suitable method. In one embodiment, cells 150 are sized and/or positioned such that first collimator grid 132 and second collimator grid 143 together form focused cells 150 of collimator 100. In the exemplary embodiment, first collimator grid 132 has outer surface 140 and an inner surface 162. More specifically, first collimator grid 132 includes a suitable number of layers 154 that cumulatively have a height $H_{C1}$. In one embodiment, first collimator grid 132 includes a number of layers 154 of radiation-absorbing material that facilitates protecting detector array 18, as described above. Further, second collimator grid 134 has an outer surface 164 and inner surface 148. More specifically, second collimator grid 134 includes a suitable number of layers 154 that cumulatively have a height $H_{C2}$. In the exemplary embodiment, the number of layers 154 forming secondary collimator grid 134 is greater than the number of layers 154 forming first collimator grid 132, however, the number of layers 154 forming secondary collimator grid 134 may be less than or equal to the number of layers 154 forming first collimator grid 132. In one embodiment, second collimator grid 134 includes a number of layers 154 of radiation-absorbing material that enables collimator assembly 106 to have a predetermined height $H_C$. Further, in one embodiment, reinforcing layer 136 is positioned at approximately a mid-plane (not shown) of collimator assembly 100, wherein the mid-plane is a plane (not shown) parallel to outer surface 138 and/or inner surface 146 and has an equal number of layers 154 between the plane and outer surface 138 and between the plane and inner surface 146.

Reinforcing layer 136, in the exemplary embodiment, is a continuous sheet of radiation-transparent or low-attenuating material and has a height HCR. Reinforcing layer 136 includes an outer surface 166 and an inner surface 168. In the exemplary embodiment, reinforcing layer outer surface 166 is adjacent and coupled to first grid inner surface 162, and reinforcing layer inner surface 168 is adjacent and coupled to second grid outer surface 164.

In the exemplary embodiment, secondary collimator 100 includes a bond layer 170 between first end surface 142 of collimator assembly 106 and second end surface 126 of first attachment wing 102, and between second end surface 144 of collimator assembly 106 and second end surface 126 of second attachment wing 104. In one embodiment, bond layer 170 has a thickness T of less than 1 mm and includes an adhesive, epoxy, such as a tungsten-loaded epoxy, and/or any other material that is suitable for bonding collimator assembly 106 to first attachment wing 102 and second attachment wing 104.

To assemble collimator assembly 106, first collimator grid 132 and second collimator grid 134 are provided such that first collimator grid 132 defines a plurality of cells 150, wherein each cell 150 is aligned in direction 153 and extends between outer surface 140 and inner surface 162, and such that second collimator grid 134 defines a plurality of cells 150, wherein each cell 150 is aligned in direction 153 and extends between outer surface 164 and inner surface 148. As used herein "providing" refers to supplying, furnishing, preparing, presenting, procuring, purchasing, transferring, producing, manufacturing, fabricating, forging, machining, molding, constructing, and/or any other suitable means to provide a component. Second collimator grid 134 is coupled to reinforcing layer 136. More specifically, in the exemplary embodiment, outer surface 164 of second collimator grid 134 is bonded to inner surface 168 of reinforcing layer 136. First collimator grid 132 is also coupled to reinforcing layer 136. More specifically, in the exemplary embodiment, inner surface 162 of first collimator grid 132 is bonded to outer surface 166 of reinforcing layer 136. In the exemplary embodiment, first collimator grid 132 and second collimator grid 134 are coupled to reinforcing layer 136 using any suitable adhesive, such as a tungsten-loaded epoxy. In one embodiment, collimator assembly 106 is fabricated by Mikro Systems, Inc. of Charlottesville, Va., using the TOMO™ process.

To assemble secondary collimator 100, in the exemplary embodiment, each attachment wing 102 and 104 is fabricated to define portions 112, 120, and 122. Apertures 110 are formed through first portion 112 of each wing 102 and 104. Second end surface 126 of each wing 102 and 104 is prepared for adhesive bonding by, for example, texturizing surface 126. Each wing second end surface 126 is coupled to a respective end surface 142 or 144 of collimator assembly 106 using bond layer 170.

Secondary collimator 100 is coupled to gantry 12 by inserting mechanical fasteners (not shown) through apertures 110 and into corresponding apertures (not shown) that are defined in gantry 12. As gantry 12 rotates, reinforcing layer 136 facilitates maintaining the shape of secondary collimator 100 and facilitates preventing deflection of collimator cells 150. During a scanning operation, cells 150 of secondary collimator 100 facilitate ensuring that scattered radiation (not shown) arriving at detector array 18 (shown in FIG. 2) has a constant scatter angle with respect to X-ray beam 36.

The above-described embodiments facilitate collimating scattered radiation within a CT detection system. More specifically, the above-described secondary collimator facilitates eliminating deflection of the secondary collimator as a gantry rotates within the system. More specifically, the above-described collimator includes a thin, solid, stiff, and relatively X-ray transparent sheet of material, or a reinforcing layer, that extends through the collimator generally perpendicular to a direction of X-ray travel. The above-described reinforcing layer facilitates providing stiffness to the collimator for loads perpendicular to the direction of X-ray travel and/or non-normal to the collimator. As such, a large, tileable collimator, which does not deflect excessively under centrifugal loads, can be fabricated. Further, the above-described method enables a modular design for the above-described collimator.

Exemplary embodiments of a secondary collimator and method for fabricating the same are described above in detail. The method and secondary collimator are not limited to the specific embodiments described herein. For example, the secondary collimator may also be used in combination with other inspection/detection systems and methods, and is not limited to practice with only the EDS as described herein. Furthermore, the method for assembly may also be used in combination with other collimator systems and methods, and is not limited to practice with only the secondary collimator as described herein.

While various embodiments of the invention have been described herein, those skilled in the art will recognize that modifications of these various embodiments of the invention can be practiced within the spirit and scope of the claims.

What is claimed is:

1. A method for fabricating a collimator assembly, said method comprising:

forming a first collimator grid having a first surface and an opposing second surface from a plurality of adjacent layers of radiation-absorbing material, the first collimator grid defining a plurality of first cells, each first cell of the plurality of first cells aligned in a first direction and extending between the first surface and the second surface and through the plurality of adjacent layers of radiation-absorbing material;

coupling a reinforcing layer to the formed first collimator grid such that the reinforcing layer extends across the plurality of first cells substantially perpendicular to the first direction; and coupling a second collimator grid to the reinforcing layer, the second collimator grid having a first surface and an opposing second surface, the second collimator grid defining a plurality of second cells extending between the first surface and the second surface, each second cell of the plurality of second cells substantially aligned with a respective first cell of the plurality of first cells of the first collimator grid.

2. A method in accordance with claim 1, wherein coupling a second collimator grid to the reinforcing layer further comprising coupling the second collimator grid to the reinforcing layer using an adhesive material.

3. A method in accordance with claim 1, further comprising coupling at least one attachment wing to the collimator assembly at least an end surface of the collimator assembly.

4. A method in accordance with claim 3, wherein the at least one attachment wing is coupled to the collimator assembly using an adhesive material.

5. A method in accordance with claim 1, further comprising coupling the collimator assembly to a gantry within a detection system using at least one mechanical fastener.

6. A method in accordance with claim 1, wherein the reinforcing layer is coupled to the first collimator grid using an adhesive material.

7. A collimator assembly, comprising:

a first collimator grid comprising a first surface and a second surface, said first collimator grid comprising a plurality of adjacent layers of radiation-absorbing material defining a plurality of first cells, each said first cell of the said plurality of first cells aligned in a first direction and extending between said first surface and said second surface and through said plurality of adjacent layers of radiation-absorbing material;

a reinforcing layer coupled to said first collimator grid such that said reinforcing layer extends across said plurality of first cells substantially perpendicular to said first direction, said reinforcing layer comprising a substantially X-ray transparent material; and a second collimator grid coupled to said reinforcing layer, said second collimator grid comprising a first surface and an opposing second surface, said second collimator grid defining a plurality of second cells that extend between said first surface of said second collimator grid and said second surface of said second collimator grid, each said second cell substantially aligned with a respective first cell of said plurality of first cells.

8. A collimator assembly in accordance with claim 7, wherein said reinforcing layer extends through each said first cell and each said second cell.

9. A collimator assembly in accordance with claim 7, wherein said reinforcing layer comprises a carbon fiber material.

10. A collimator assembly in accordance with claim 7, wherein said first collimator grid comprises a tungsten-loaded epoxy.

11. A collimator assembly in accordance with claim 7, further comprising at least one attachment wing coupled to said collimator assembly, said at least one attachment wing comprises a material having a higher tensile strength than a tungsten-loaded epoxy.

12. A detection system, comprising:

an X-ray source for generating an X-ray beam;

a multi-row detector;

an examination zone defined between said X-ray source and said multi-row detector; and a collimator assembly coupled between said multi-row detector and said examination zone, said collimator assembly comprising:

a first collimator grid comprising a first surface and a second surface, said first collimator grid comprising a plurality of adjacent layers of radiation-absorbing material defining a plurality of first cells, each said first cell of said plurality of first cells aligned in a first direction and extending between said first surface and said second surface and through said plurality of adjacent layers of radiation-absorbing material;

a reinforcing layer coupled to said first collimator grid such that said reinforcing layer extends across said plurality of first cells substantially perpendicular to said first direction, said reinforcing layer comprising a substantially X-ray transparent material; and a second collimator grid coupled to said reinforcing layer, said second collimator grid comprising a first surface and an opposing second surface, said second collimator grid comprising a plurality of adjacent layers of radiation-absorbing material defining a plurality of second cells that extend between said first surface of said second collimator grid and said second surface of said second collimator grid, each said second cell of said plurality of second cells substantially aligned with a respective first cell of said plurality of first cells.

13. A detection system in accordance with claim 12, wherein said reinforcing layer comprises a carbon fiber material.

14. A detection system in accordance with claim 12, wherein said first collimator grid comprises a tungsten-loaded epoxy.

15. A detection system in accordance with claim 12 further comprising at least one attachment wing coupled to said collimator assembly.

16. A detection system in accordance with claim 15, further comprising a gantry coupled to said X-ray source and said detector, wherein said at least one attachment wing is coupled to said gantry.

17. A detection system in accordance with claim 12, wherein said first collimator grid comprises a grid of first cells, wherein a number of first cells within said grid is equal to a number of elements of said multi-row detector.

* * * * *